US012038014B2

(12) United States Patent
Korupp

(10) Patent No.: US 12,038,014 B2
(45) Date of Patent: Jul. 16, 2024

(54) HOUSING ELEMENT FOR A PUMP AND PUMP/HOUSING ELEMENT COMBINATION

(71) Applicant: Herborner Pumpentechnik Gmbh & Co KG, Herborn (DE)

(72) Inventor: Sascha Korupp, Asslar-Werdorf (DE)

(73) Assignee: Herborner Pumpentechnik Gmbh & Co KG, Herborn (DE)

( * ) Notice: Subject to any disclaimer, the term of this patent is extended or adjusted under 35 U.S.C. 154(b) by 0 days.

(21) Appl. No.: 18/104,918

(22) Filed: Feb. 2, 2023

(65) Prior Publication Data

US 2023/0175519 A1 Jun. 8, 2023

Related U.S. Application Data

(63) Continuation of application No. 17/725,788, filed on Apr. 21, 2022, now Pat. No. 11,761,453.

(30) Foreign Application Priority Data

Apr. 28, 2021 (DE) ..... 10 2021 110 936.1

(51) Int. Cl.
*F04D 29/44* (2006.01)
*F04D 29/22* (2006.01)
*F04D 29/24* (2006.01)

(52) U.S. Cl.
CPC ..... *F04D 29/2244* (2013.01); *F04D 29/242* (2013.01); *F04D 29/441* (2013.01)

(58) Field of Classification Search
CPC ..... F04D 29/441; F04D 29/403
See application file for complete search history.

(56) References Cited

U.S. PATENT DOCUMENTS

| | | | | |
|---|---|---|---|---|
| 4,475,868 | A | 10/1984 | Renger | |
| 9,297,385 | B2 * | 3/2016 | Yamanaka | F04D 1/006 |
| 11,339,804 | B2 * | 5/2022 | Pohler | F04D 7/02 |
| 2005/0207891 | A1 | 9/2005 | Shaw | |
| 2007/0274820 | A1 | 11/2007 | Lindskog | |
| 2014/0030086 | A1 | 1/2014 | Staley et al. | |
| 2020/0040915 | A1 | 2/2020 | Pohler et al. | |
| 2021/0003134 | A1 | 1/2021 | Sinico et al. | |

FOREIGN PATENT DOCUMENTS

| | | |
|---|---|---|
| DE | 35 20 263 | 12/1986 |
| DE | 37 04360 | 8/1988 |
| DE | 10 2015 211 173 | 7/2016 |
| EP | 1 134 420 A2 | 9/2001 |
| EP | 1 134 420 A3 | 8/2002 |
| JP | 09-4585 | 1/1997 |
| WO | 2004/065797 | 8/2004 |
| WO | 2016/165795 | 10/2016 |
| WO | 2017/001340 | 1/2017 |

* cited by examiner

*Primary Examiner* — Sabbir Hasan
(74) *Attorney, Agent, or Firm* — Clark & Brody LP

(57) ABSTRACT

A housing element for a pump or of a pump has a housing inner wall defining a flow channel for a fluid medium extending along a central axis. The cross section of the flow channel is greater in a main flow direction and the housing inner wall has a surface structure configured such that it counteracts a return flow counter to the main flow direction along the housing inner wall of the fluid medium. The housing element can act as a pump housing and be combined with a pump.

10 Claims, 5 Drawing Sheets

HOUSING ELEMENT FOR A PUMP AND PUMP/HOUSING ELEMENT COMBINATION

The invention relates to a pump impeller, a housing element, and a pump containing the housing element.

The invention relates, in particular, to components of vortex pumps which are also denoted in common parlance as recessed impeller pumps. Vortex pumps are frequently used in the pumping of waste water. Waste water is characterized in that the exact composition thereof is frequently unknown. Frequently, the waste water contains a high proportion of solids such as long-fibre substances, coarse constituents such as grit or chemically aggressive substances. In this case, vortex pumps provide a reliable and robust pump operation, wherein the efficiency thereof is nevertheless frequently slightly reduced relative to other pump hydraulic systems.

A pump impeller with two opposingly arranged sets of blades is disclosed in WO 2017/001340 A1. The blades have a non-uniform material thickness. DE 35 20 263 A1 discloses a pump impeller which has blades with a blade cover. The pump impellers in each case have a single blade type.

The object of the invention is to increase the efficiency of a pump and, in particular, a vortex pump with as far as possible constant power consumption and in this regard to optimize the flow guidance and thus the resource efficiency. The solution is intended to permit a reliable continuous operation and to be cost-effective.

One aspect according to the invention relates to a pump impeller with an impeller surface and a rotational direction, wherein blades are arranged on the impeller surface, wherein at least one of the blades is a blade of a first type, and wherein the blade geometry of the blade of the first type has a blade edge which is inclined toward the front in the rotational direction. The inclination of this edge contributes to the vortex produced upstream of the pump wheel being drawn more powerfully into the pump impeller, in particular between the individual blades. The inclination may be configured by a slope and/or a radius. Moreover, the inclination may be configured, however, so as to start on the impeller surface or only start spaced apart from the impeller surface.

Optionally all of the blades of the pump impeller may be blades of the first type. As a result, the efficiency of the pump impeller may be significantly increased relative to versions without such a blade edge.

According to a further aspect according to the invention, in the case of a pump impeller with an impeller surface on which blades are arranged, wherein at least one of the blades is a blade of the first type, it is provided that at least one of the blades is a blade of the second type, wherein the blade geometry of the blade of the first type differs from the blade geometry of the blade of the second type.

As a result, a functional separation is achieved in the suctioning of the fluid into the intermediate space between the blades and a retention therein and an acceleration radially outwardly along the blades. The different blade geometries may be adapted to one another such that the flow guidance of a fluid pumped through the pump impeller is optimized by avoiding turbulence. Corresponding blade wheels thus have a higher pump head than blade wheels which only comprise blades of one type having a single geometry. The power consumption of the impeller according to the invention in this case is comparable with the impellers which are known from the prior art and in this regard the efficiency is increased.

According to an optional variant of this pump impeller, the blade geometry of the blade of the first type has a blade edge which is inclined toward the front in the rotational direction. These contribute significantly to the pumping of fluid into the intermediate space between the blades.

The pump impeller preferably has a (preferred) rotational direction (simply called rotational direction hereinafter, even if in theory the impeller could be easily driven so as to rotate backwards) and/or an imaginary rotational axis about which the pump impeller is designed to rotate during operation. The imaginary rotational axis (in some cases simply called rotational axis hereinafter) runs, for example, through an impeller hub in the impeller surface which serves for fastening to a drive shaft. The impeller hub may be, for example, a shaft receiver and may be configured, in particular, as a bore in the impeller surface (for example with a feather key groove) or a shaft pin (for example with a feather key groove and/or for example cylindrically or conically). The rotational axis is oriented in parallel and/or coaxially to the drive shaft and/or the bore. The rotational axis runs transversely, preferably at right angles, to the impeller surface.

The impeller surface should be configured from an impeller base or impeller plate which is oriented transversely to the rotational axis, the rotational axis running through the centre thereof. The impeller surface is closed and is configured such that the pumped fluid leaves the impeller radially and thus is discharged transversely, in particular at right angles to the rotational axis.

The blades have a blade pressure surface which faces toward the front in the rotational direction and a blade suction surface which faces toward the rear in the rotational direction. The base body of the blade geometry of the blades of the first type and/or the blades of the second type may extend outwardly in each case away from the rotational axis such that it runs in a linear manner (linear blading) and optionally is oriented at right angles to the rotational axis. Alternatively, the base body may have a curvature outwardly from the rotational axis (curved blading) which extends, in particular, over the impeller surface and is more than 0° and up to 270° in size.

Additionally, the impeller may be characterized in that the blade geometry of the blades of the first type and/or the blades of the second type runs in a direction which runs outwardly radially away from the rotational axis and has a convex blade pressure surface and/or a concave blade suction surface. The path of the blade suction surface and/or the blade pressure surface may be circular segment-shaped and/or cylinder segment-shaped.

The pump impeller is suitable as a pump impeller for a vortex pump.

Moreover, it may be advantageous if the blade pressure surface and/or the blade suction surface of the blade edge is inclined toward the front in the rotational direction. The inclination toward the front positively influences the pressure build-up. Additionally, the blade of the first type may be subdivided along a curvature and/or along a sharp bend into a base body and the blade edge, wherein preferably the blade edge is arranged spaced apart from the impeller surface. The inclination is produced by the curvature or the sharp bend.

In this case, the blade edge may be inclined by an angle w1 relative to an imaginary rotational plane in which the impeller surface rotates (during operation) in the rotational direction, wherein the angle w1 is preferably between 55° and 87° or between 60° and 80° or between 65° and 75°. This contributes to the optimization of the flow guidance. Additionally, it is advantageous if the blade geometry of the blade of the first type has a convex blade pressure surface and a concave blade suction surface, wherein in particular the convex blade pressure surface has the angled blade edge and/or the concave blade suction surface has the angled blade edge. The blade edge preferably has a free end to which no further element of the blade is adjoined. It is also optionally possible, however, to provide a blade of the first type with an inclined blade edge additionally with a blade cover which faces across the blade suction surface.

Additionally, it may advantageous if the blade edge is arranged on a base body of the blade geometry of the blade of the first type, wherein the base body adjoins the impeller surface and, in particular, the blade edge is arranged spaced apart from the base body and, in particular, forms a free end. The pulse transmission to the fluid medium is optimized by the base body.

An optional aspect of the invention is that the blade geometry of the blade of the second type comprises a base body which adjoins the impeller surface and comprises a blade cover which adjoins the base body, wherein a pumping channel is configured between the blade cover, the base body and the impeller surface. The blade cover contributes to an optimized flow guidance since it reduces turbulence. In this regard, the turbulence in the pumping channel is reduced. The pumping channel is defined on three sides by the blade cover, the base body and the impeller surface. It ensures a greater dynamic pressure within the flow guided therein. In this case, it may be advantageous if the blade geometry of the blades of the first type does not have a blade cover. It is particularly advantageous if the blades of the first type and of the second type are arranged alternately in the rotational direction, wherein the blades of the second type have blade covers and the blades of the first type do not have blade covers. The blades may be arranged at a uniform rotational angular spacing. Optionally, however, it is also possible to configure an uneven distribution of the blades. In this case, it might always be advantageous to arrange two neighbouring blades closer to one another as a pair than to a neighbouring pair. The greater spacing is thus preferred between the optional blade edge and the opposing blade cover. In this case, the greater blade spacing should be configured between the blade of the first type provided with the blade edge and the second type of blade arranged upstream thereof in the rotational direction and provided with a blade cover. In other words, therefore, the opening angle between the blade pressure surface of the blade of the first type and the blade suction surface of a blade of the second type arranged upstream thereof in the rotational direction is greater than the opening angle between the blade pressure surface of the blade of the second type and the blade suction surface of a blade of the first type arranged upstream thereof in the rotational direction.

Additionally, it may be advantageous if the pump impeller has a rotational direction, and a blade channel, which is configured in the rotational direction between the blade of the second type and another of the blades, is partially covered by the blade cover. Thus the flow guidance may be optimized particularly effectively and the turbulence minimized. The partial cover ensures a sufficient inflow into the pumping channel.

In this case, it may be advantageous if the blade cover covers the blade channel in the rotational direction by between 30% and 70%, so that a gap remains free along the blade channel. The gap may extend in this case over the entire length of the blade channel, wherein the length extends radially to the rotational axis, i.e. from inside to outside. The blade cover in this case covers a width of the blade channel, wherein the width extends in the rotational direction. The pumping channel is open on a radially outer blade wheel edge on the outer circumference of the pump impeller so that a pumped fluid may escape out of the pumping channel radially to the rotational axis. This aspect contributes to the flow guidance being further optimized and the turbulence being minimized.

In this case, it is additionally advantageous if the base body is oriented with a maximum deviation of +/−20°, preferably +/−10°, further preferably +/−5° and particularly preferably +/−2° parallel to the rotational axis. Additionally, the base body may be oriented with a maximum deviation of +/−20°, preferably +/−10°, further preferably +/−5° and particularly preferably +/−2° at right-angles relative to the impeller surface. The base body is thus located in a perfectly linear manner on the impeller surface or extends perpendicularly (+/− the specified deviation) away from the impeller surface. These aspects lead to the flow guidance being optimized and the turbulence being minimized.

Moreover, it may be advantageous if the blade cover is oriented with a maximum deviation of +/−20°, preferably +/−10°, further preferably +/−5° and particularly preferably +/−2°, parallel to an imaginary rotational plane in which the impeller surface rotates (during operation) in the rotational direction and/or is oriented at right-angles to the base body. Additionally, the blade cover may be oriented with a maximum deviation of +/−20°, preferably +/−10°, further preferably +/−5° and particularly preferably +/−2° parallel to the impeller surface. This aspect also contributes to the flow guidance being optimized and the turbulence being minimized.

It may also be advantageous if the pump impeller has a rotational direction and the blade cover protrudes over the base body counter to the rotational direction. In this regard, according to the blade geometry of the blade of the second type, the pumping channel may be arranged in the rotational direction downstream of the corresponding base body, wherein preferably the surface of the base body adjoining the pumping channel is the blade suction surface and the opposing side of the base body is a blade pressure surface. This measure also ensures an optimized flow guidance and a minimized turbulence.

It may also be advantageous if the blade geometry of the blade of the first type and/or the blade of the second type has a uniform material thickness with a maximum deviation of +/−30°, preferably +/−20°, further preferably +/−10° and particularly preferably +/−5°. Optionally, the blade pressure surface and the blade suction surface may run in parallel. The production process, in particular the cooling process during casting, is optimized by the uniform material thickness. The blade impeller preferably consists of metal. In any case, due to the blade edge and the blade cover described herein, it is unlikely that a casting mould is used without cores, which is why significantly less consideration has to be given to draft angles and all surfaces are able to be optimized in terms of efficiency.

Moreover, it may be advantageous if the same number of blades of the first type and blades of the second type is provided. In this manner the cooperation of the different blade types is optimized.

It is additionally advantageous if the blades of the first type and the blades of the second type are arranged alternately one behind the other in a rotational direction of the pump impeller. The flow guidance is directly influenced by two adjacent blades. In this regard, the cooperation of the different blade types is optimally utilized thereby.

Additionally, it is advantageous if the pump impeller is configured as a vortex impeller. In this case, the impeller surface of the pump impeller is a closed surface and the axially inflowing fluid is pumped radially to the rotational axis out of the region of the pump impeller. Thus a deflection of the flow guidance is achieved.

The object is additionally achieved by the housing element for a pump or of a pump. The housing element has a housing inner wall which defines a flow channel for a fluid medium extending along a central axis, wherein the cross section of the flow channel is greater in a main flow direction. The housing inner wall has a surface structure which is configured such that it counteracts a return flow counter to the main flow direction along the housing inner wall of the fluid medium. This measure increases the pressure build-up in the pump housing since the return flow into the suction region of the pump is minimized. This accordingly minimizes a loss of power of the pump and, in particular, higher pumping rates are pumped more efficiently. The flow guidance is optimized. In this regard, the surface structure may have at least one inflow surface which protrudes transversely into the return flow. The inflow surface swirls the return flow and accordingly reduces it. Preferably no inflow surfaces protruding into the rotational flow are present in the circumferential direction. The rotation triggered by the pump impeller is thus not decelerated, but only the return flow.

According to a more detailed embodiment, the surface structure has at least one shoulder. The shoulder forms the inflow surface and counteracts the return flow. Moreover, the shoulder forms for the main flow direction a shadow in which a negative pressure is produced in the case of overflow. The return flow is then not only hindered on the shoulder but the main flow suctions the return flow back into the main flow. The shoulder may protrude, in particular, transversely into the return flow. Moreover, the shoulder may be configured to be rotationally symmetrical. The shoulder may be configured with an undercut, in particular, such that the return flow flows at least slightly below the shoulder. In the main flow direction this undercut hardly interrupts the flow. Relative to the return flow, the undercut may intensify the deflection thereof. To this end, the undercut may form a radius. No undercuts should be formed in the main flow direction. This improves the demouldability. Preferably, draft angles of at least 1.5° are maintained in the main flow direction. Moreover, no tapering should be formed in the flow channel between a plurality of shoulders in the main flow direction.

Moreover, it is advantageous if the at least one shoulder is configured in an annular or at least annular segment-shaped manner. The annular or at least annular segment-shaped shoulder may run in a circumferential direction about the central axis. Due to this configuration, the counteraction is particularly efficient and the formation of the shoulder may also be achieved in a cost-effective manner.

Moreover, it is advantageous if the surface structure has at least one or two or three further shoulders. The shoulders are arranged spaced apart from one another relative to a direction radially to the central axis and/or the main flow direction. The spacings and the number of shoulders may be adapted to the respective pump size. Optionally, the surface structure may also have at least five or at least six or at least ten or even significantly more than ten shoulders. The return flow is increasingly reduced by the surface structure which is also produced from the additional shoulders. Preferably, the shoulder is or the shoulders are a macro structure. To this end, the shoulder preferably has a shoulder height of at least 0.5 mm or at least 1.0 mm or at least 2.0 mm or at least 3.0 mm.

Preferably, the further shoulders are arranged evenly spaced apart in the direction radially to the central axis and/or the main flow direction. The further shoulders may be configured in an annular or at least annular segment-shaped manner. The further annular or at least annular segment-shaped shoulders may run in a circumferential direction about the central axis. Thus the return flow is particularly efficiently suppressed.

Alternatively, it may be advantageous if the shoulder is configured to be spiral-shaped and preferably is wound radially outwardly starting from the central axis, preferably by more than 360° or more than 720° or more than 1080° or even have significantly more revolutions. The return flow may also be efficiently suppressed thereby. The winding of the spiral-shaped shoulder optionally rising in the direction of the pump impeller improves the flow guidance in the direction of the pump impeller.

It may also be advantageous if the shoulder has a wedge-shaped or trapezoidal cross-sectional profile. As a result, an undercut may be formed. In this case it is the basic shape, wherein for example radii may also be formed on the edges. The return flow flows into this undercut and is decelerated. As a result, the return flow is particularly efficiently suppressed. In the main flow direction, however, the fluid simply overflows the shoulder. Further alternatives may have a round or oval cross section. In principle, many different basic shapes are considered as the shape of the shoulder. Preferably, however, these shapes do not form an obstruction to the flow in the main flow direction but only counter to the main flow direction.

In a specific embodiment, the shoulder is configured to be step-shaped. A step is characterized, in particular, in that the step is ascended in the main flow direction and descended counter to the main flow direction. Optionally, in the case of a plurality of step-shaped shoulders, a set of steps results.

Additionally, it may be advantageous if the housing inner wall has a conical basic shape, the surface structure being configured thereon. In this case, the housing inner wall may preferably be widened in the main flow direction. Thus the housing element is particularly suitable for a vortex pump. Preferably, the conical basic shape is configured in a linear manner. As a result, a fluid vortex inside the housing element is hindered to a lesser extent. However, oblique conical basic shapes may also be considered, in particular slightly oblique conical basic shapes. Thus, for example, the pump connection may be positioned so as to be slightly deviating. Preferably the conical basic shape is a flat cone, namely in particular a cone with an opening angle of at least 20 degrees.

Moreover, it may be advantageous if the housing element has a fluid inlet opening in the main flow direction at the start of the flow channel, wherein the fluid inlet opening is aligned with the central axis. During assembly, the fluid inlet opening may be arranged, in particular, in the region of the pump inlet. For example, in this manner a top cover which forms the housing element may also be suitable for forming the pump inlet of a vortex pump.

It may also be advantageous if the housing element is configured as a releasable top cover of a pump housing, in particular of the pump. The top cover is releasable in the sense that it is attached by means of at least one releasable fastening device to at least one further element of the housing. Typical fastening devices are screws and/or clamps. The releasable top cover may be configured with a fastening flange and preferably have screw holes. Since the top cover is releasable, the housing element may be dismantled and is thus simple to maintain and to replace where necessary. Alternatively or additionally, the housing may form an impeller chamber of a pump housing. Specifically in this case, potential return flows are formed on the inner wall, namely due to the vortex produced and the pressure at the pump outlet, which may be accordingly reduced by the housing element. A further alternative or additional embodiment may be that the housing element is an insert element in an impeller chamber of a pump housing. Such insert elements may be mounted in the interior of an impeller chamber (for example tightly screwed) and replaced where required, in particular when, for example, abrasion or deposits impair the function of the shoulder or the shoulders.

The invention is additionally achieved by a pump with a pump housing in which a pump impeller is rotatably mounted, a fluid medium being able to be pumped from a pump inlet of the pump housing to a pump outlet of the pump housing, wherein the pump housing has a housing element as described above and below, the flow channel thereof being arranged between the pump inlet and the pump impeller, and/or the pump impeller is configured as described above and below. The efficiency of the pump is optimized by the use of at least one of the measures as described above. The above-described effects are correspondingly present in combination so that the pump characteristic curve is optimized. Thus the pump impeller already reduces the return flow, which is additionally reduced by the surface structure of the housing element.

With regard to this aspect it may be advantageous if the pump impeller is arranged in the direction of the main flow direction relative to the housing element. The central axis of the housing element may be parallel and/or coaxial to the rotational axis of the pump impeller.

The housing element preferably forms a wall of a pump hydraulic system, wherein the pump impeller is arranged in an impeller chamber of the pump hydraulic system. Preferably, it is a radial pump hydraulic system. The pump inlet should be aligned with the pump impeller. A free space without further flow guidance elements is provided inside the impeller chamber between the housing element and the pump impeller. Preferably, the pump outlet is oriented at right-angles to the pump inlet and leads radially from the pump impeller out of the impeller chamber. A spiral-shaped fluid vortex is formed between the pump inlet, which is formed by the housing element, and the pump impeller and leads to a return flow along the housing inner wall of the housing element which then collides with the surface structure and forms a vortex. Thus the restriction of the return flow is particularly effective.

It may also be advantageous if the pump is a vortex pump. The aforementioned advantages are particularly relevant in the case of vortex pumps.

Further features, details and advantages of the invention emerge from the wording of the claims and from the following description of exemplary embodiments with reference to the drawings, in which:

Figure 1:
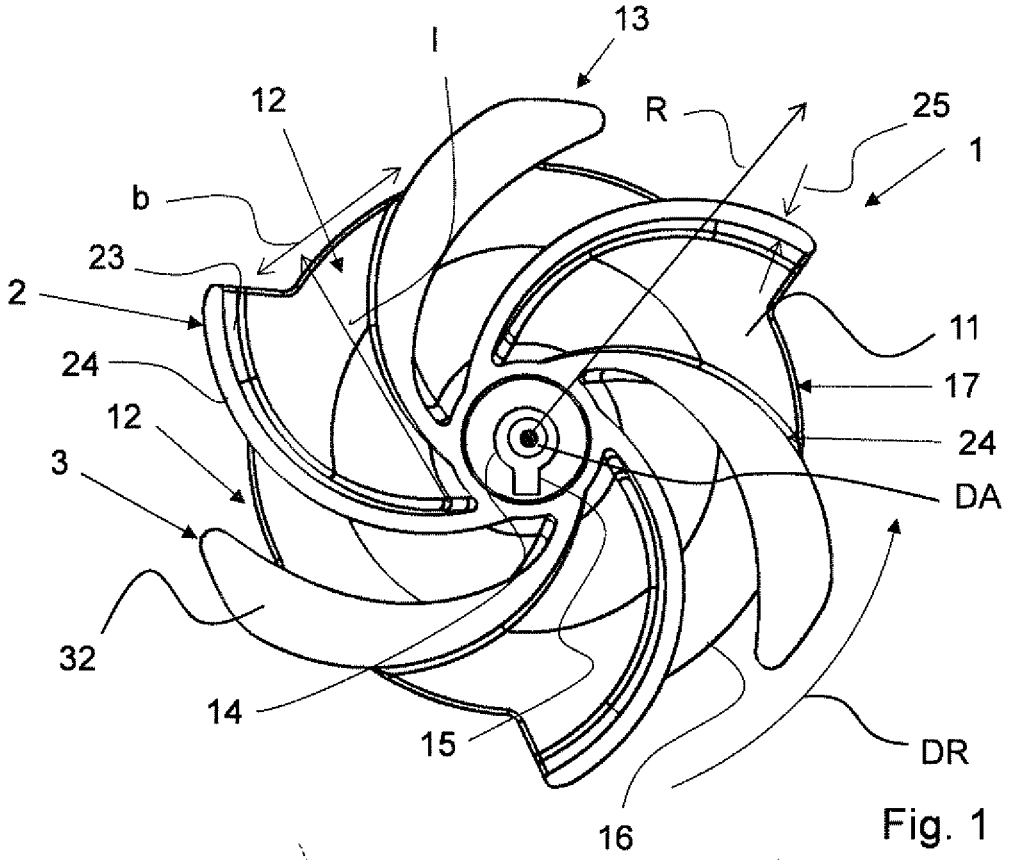
FIG. 1 shows a plan view of a pump impeller.

According to FIG. 1 and FIG. 2 a pump impeller 1 has an imaginary rotational axis DA about which the pump impeller 1 is designed to rotate during operation (simply called rotational axis DA hereinafter). The rotational axis DA runs through an impeller hub 14 in the centre of an impeller surface 11, wherein the impeller hub 14 has a feather key groove 15. A shaft of a drive unit of a pump may be received by the impeller hub 14. The rotational axis DA is coaxial to the impeller hub 14. The impeller surface 11 is closed and formed such that a pumped fluid leaves the pump impeller 1 radially. The pumped fluid is discharged at right-angles to the rotational axis DA.

The pump impeller 1 additionally has three blades of the first type 2 and three blades of the second type 3 which are arranged on the impeller surface 11. The impeller surface 11 is oriented at right-angles to the rotational axis DA and the pump impeller 1 is configured as a vortex impeller. The impeller surface 11 between the blades 2, 3 is configured in each case so as to be closed so that no fluid is able to pass parallel to the rotational axis DA through the pump impeller 1.

The pump impeller 1 is rotatable in a rotational direction DR about the rotational axis DA. In this case it is the preferred rotational direction DR during operation. The blades of the first type 2 and the blades of the second type 3 are arranged alternately one behind the other in the rotational direction DR.

The blades of the first type 2 have a blade pressure surface 24 and a blade suction surface 23. The blades of the second type 3 accordingly have a blade pressure surface 34 and a blade suction surface 35. The blade pressure surfaces 24 run in each case in a convex manner in a direction R radially away from the rotational axis DA. The blade suction surfaces 23 run in each case in a concave manner in the direction R, which corresponds to the radius. This results in a so-called curved blading. Along this path of the blades 2, 3 the blade pressure surfaces 24 and blade suction surfaces 23 form circular segments. The blades of the first type 2 and second type 3 have a uniform material thickness 25, 37. Thus the path of the respective blade pressure surface 24, 34 and the blade suction surface 23, 35 is at least substantially parallel.

The blade geometry of the blade of the first type 2 differs form the blade geometry of the blade of the second type 3.

The blade geometry of the blade of the first type 2 has a base body 21 which adjoins the impeller surface 11. The base body 21 runs parallel to the rotational axis DA and is oriented at right angles to the impeller surface 11. A blade edge 22 adjoins the base body 21. The blade edge 22 in this regard is spaced apart from the impeller surface 11. A curvature 27 runs between the base body 21 and the blade edge 22. Alternatively it may be a sharp bend. Due to the curvature 27 the blade edge 22 is inclined by an angle w1 of approximately 70° relative to an imaginary rotational plane in which the impeller surface 11 (during operation) rotates in the rotational direction DR. In particular, the angle w1 should be between 55° and 87° or between 60° and 80° or between 65° and 75°. Accordingly, the blade edge 22 is inclined at an angle of w2 of approximately 20° relative to the base body 11 which is oriented in the present case at right angles to the rotational plane. Due to the uniform material thicknesses 25, 37 the blade pressure surface 24 and the blade suction surface 23 are parallel. Thus both the blade pressure surface 24 and the blade suction surface 23 are inclined at the angles w1 and w2. Additionally, the blade edge 22 and therewith both the blade pressure surface 24 and the blade suction surface 25 are inclined toward the front in the rotational direction DR. The blade edge 22 has a free end 26, to the extent that no further element adjoins the blade edge 22. The base body 21 forms together with the blade edge 22 the blade pressure surface 24 and the blade suction surface 23.

The blade of the second type 3 has a base body 31 and a blade cover 32. The base body 31 adjoins the impeller surface 11 and is oriented at right-angles relative to the base body 31. Additionally, the base body 31 is oriented parallel to the rotational axis DA. The blade cover 32 adjoins the base body 31 and is arranged spaced apart from the impeller surface 11. In particular, the blade cover 32 is oriented parallel to the imaginary rotational plane in which the impeller surface 11 (during operation) rotates in the rotational direction DR. A pumping channel 13 thus formed is defined on three sides by the blade cover 32, the base body 31 and the impeller surface 11. The blade cover 32 is also oriented at right-angles to the base body 31 and the rotational axis DA. The blade cover 32 is also oriented parallel to the impeller surface 11. In this case, the blade cover 32 protrudes over the base body 31 counter to the rotational direction DR, thus over the blade suction surface 35.

The pumping channel 13 is defined between the blade suction surface 35 of the base body 31 and the blade cover 32 of the blade of the second type 3 and the impeller surface 11. A blade channel 12 is formed between blades 2, 3 which are adjacent in the rotational direction DR. A part of the blade channel 12 is formed by the pumping channel 13. The blade channel 12 is partially covered to approximately 25-75% by the blade cover 32, so that along the blade channel 12 a gap 16 remains free for the inflow of fluid. The gap 16 extends over the entire length l of the blade wheel channel 12, wherein the length l runs radially to the rotational axis DA. The blade cover 22 in this case covers the width b of the blade channel 12, wherein the width b extends in the rotational direction DR. The pumping channel 13 is open on a radially outer blade wheel edge 17 so that a pumped fluid may escape in the radial direction R out of the pumping channel 13. The blade wheel edge 17 is located on the outer circumference of the pump impeller 1.

Figure 2:
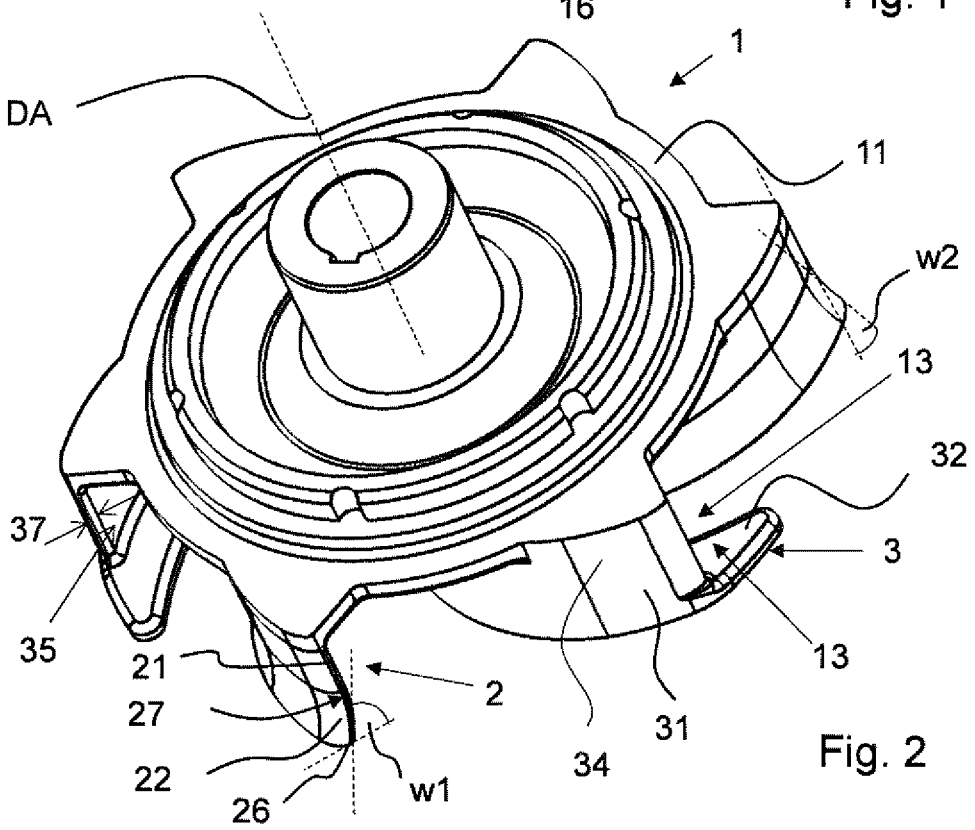
FIG. 2 shows a perspective view of the pump impeller of FIG. 1 from below.
Figure 3:
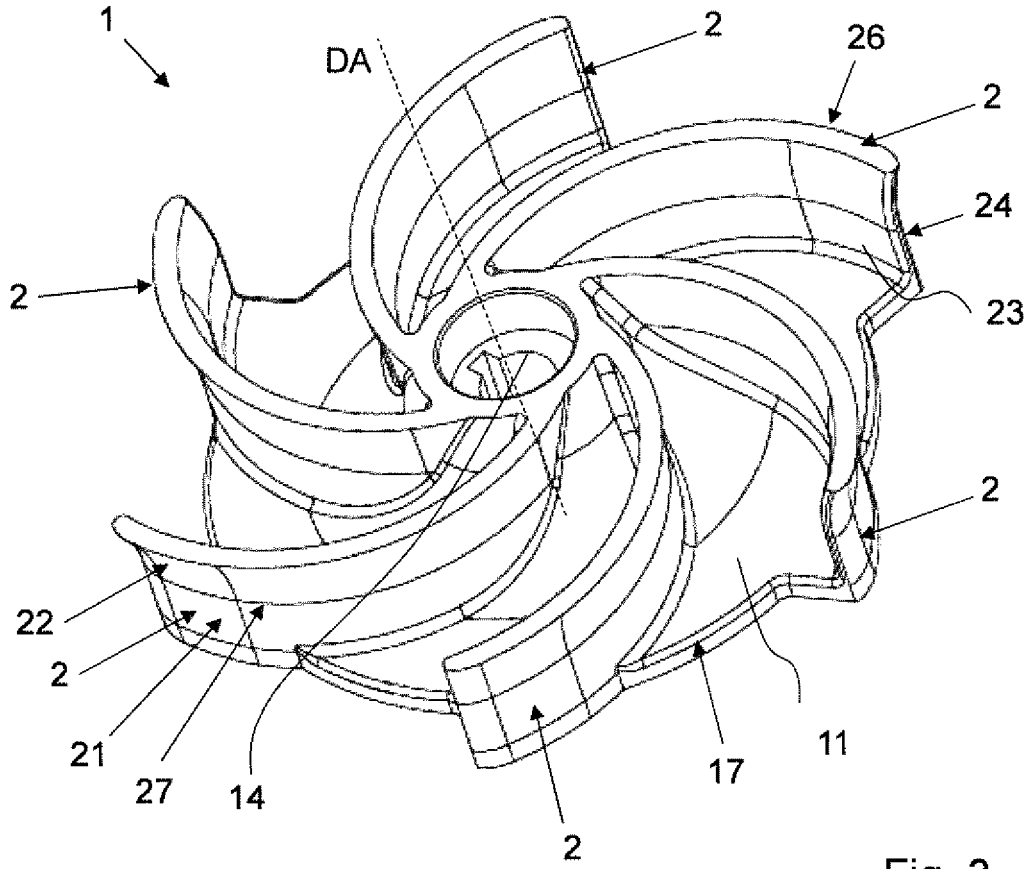
FIG. 3 shows a perspective view of a pump impeller from above.

A pump impeller 1 shown in FIG. 3 differs, however, from the pump impeller of FIGS. 1 and 2 in that instead of the three blades of the second type 3, it has blades of the first type 2. Thus the pump impeller 1 exclusively has blades of the first type 2, namely here in particular six thereof.

Figure 4:
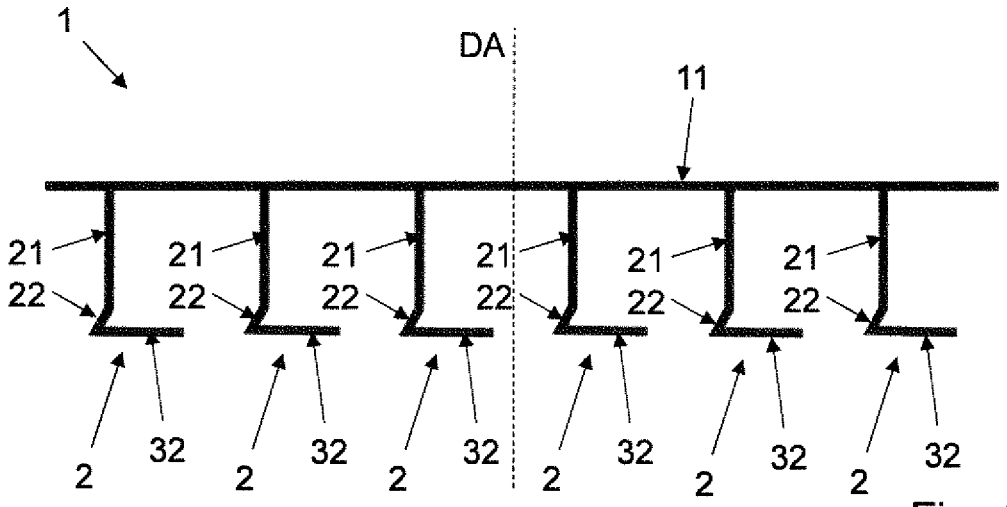
FIG. 4 shows a schematic development of a pump impeller.

The sketch of FIG. 4 shows a development of a pump impeller 1, wherein the blade geometries differ from those of FIG. 3 such that the blade edge 22 does not form a free end 26. Instead a blade cover 32 is adjoined thereto, said blade cover in principle having the same features as the blade cover of the blades of the second type 3 of FIGS. 1 and 2. Whilst the blade edge 22 is inclined toward the front in the rotational direction, i.e. in the direction of the blade pressure surface 24, the blade cover 32 protrudes from the end of the blade edge 22 toward the rear in the rotational direction, in particular beyond the blade suction surface 23.

A further modification of the pump impeller 1 according to the invention may comprise that in contrast to the view of FIGS. 1 and 2 it is provided that in each case pairs consisting of a blade of the first type 2 and a blade of the second type 3 may be provided, wherein a greater blade spacing is formed between the first type of blade 2 provided with the blade edge 22 and the adjacent second type of blade 3 provided with the blade cover 32. In particular, the opening angle between the blade pressure surface 24 of the blade of the first type 2 and the blade suction surface 35 of an adjacently arranged blade of the second type 3 is greater than the opening angle between the blade pressure surface 34 of the blade of the second type 3 relative to the blade suction surface 23 of an adjacently arranged blade of the first type 2.

Figure 5:
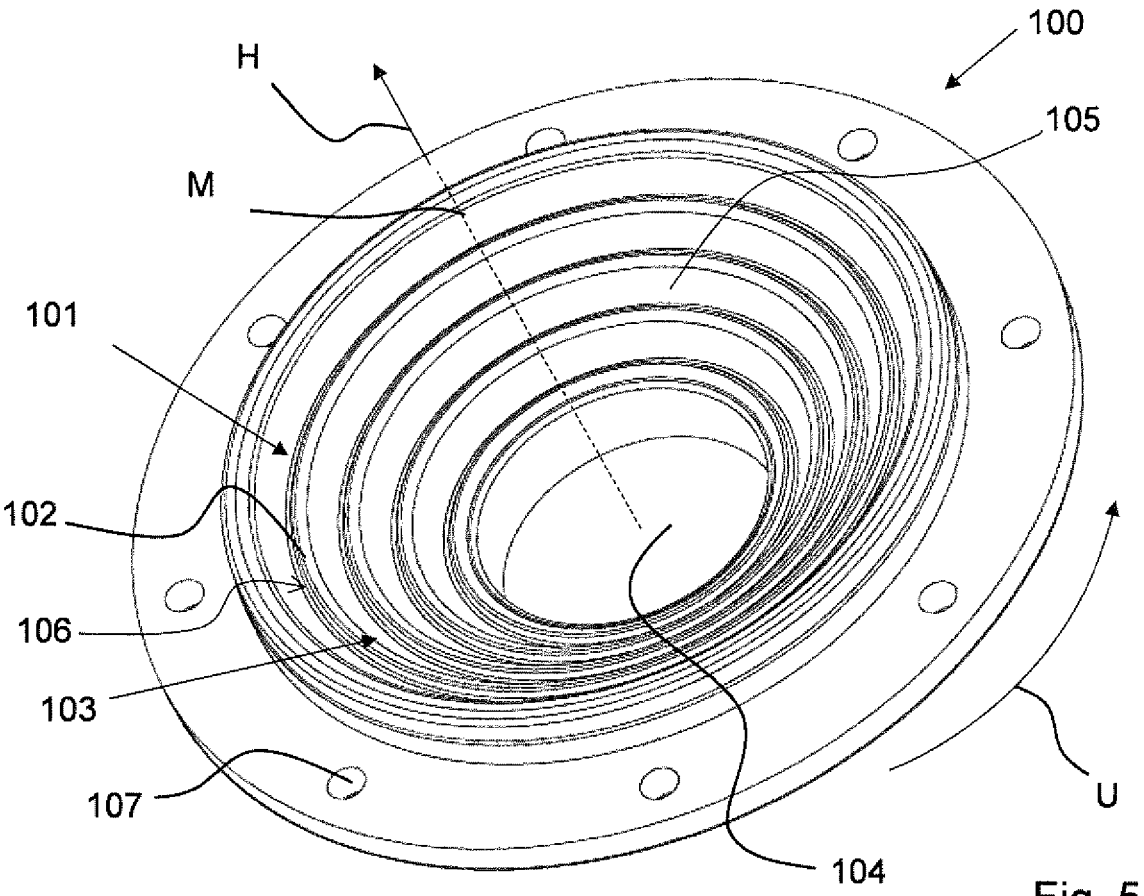
FIG. 5 shows a perspective view of a housing element.
Figure 6:
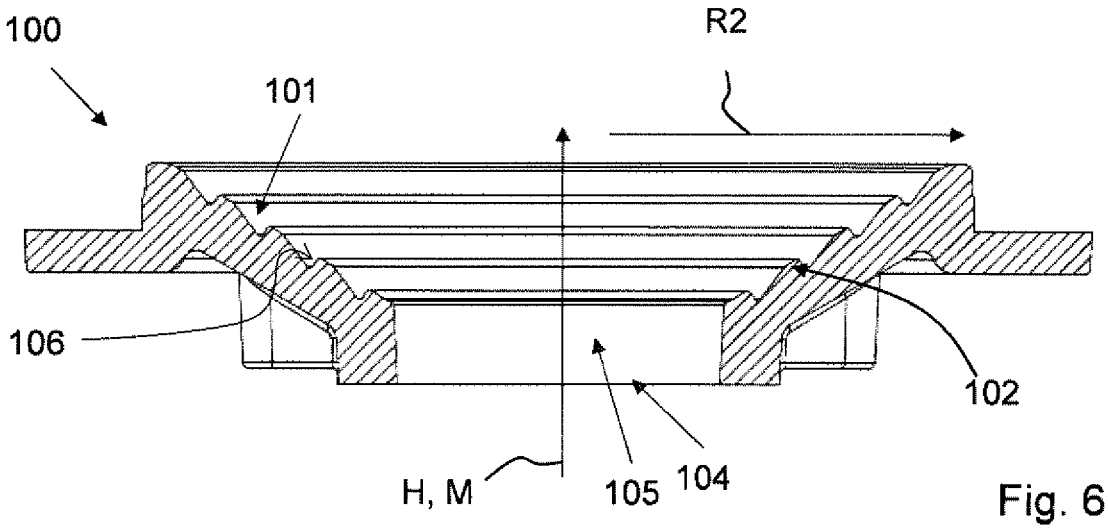
FIG. 6 shows a cross section through the housing element of FIG. 5.

According to FIG. 5 and FIG. 6 a housing element 100 is configured as a releasable top cover, in particular with a fastening flange, of a pump 200. The housing element 100 advantageously has screw holes 107 in the fastening flange. The housing element 100 additionally as a housing inner wall 103. The housing inner wall 103 has a conical basic shape which extends along a central axis M. The housing inner wall 103 defines a flow channel 105 for a fluid medium which is able to be pumped in a main flow direction H through the flow channel 105. The main flow direction H is coaxial to the central axis M. A fluid inlet opening 104 is provided at the start in the main flow direction H. The flow channel 105 widens in the main flow direction H. The surface structure 101 is configured such that it counteracts a return flow counter to the main flow direction H along the housing inner wall 103.

In this regard, the surface structure 101 has an inflow surface 106 which protrudes transversely to the return flow. The inflow surface 106 has a plurality of shoulders 102 which form an undercut relative to the conical housing inner wall 103. The shoulders 102 are in each case formed rotationally symmetrically relative to the central axis M. In this sense, the shoulder 102 is of annular configuration, wherein the shoulder runs in a circumferential direction U around the central axis M. In the present case, a total of four shoulders 102 are provided, wherein a greater or smaller number of shoulders 102 may also be provided. The shoulders 102 are arranged evenly spaced apart in the main flow direction H and in a direction R2 radial thereto. Thus the shoulders 102 in each case run parallel to one another. The further shoulders 102, the number thereof being variable, are also of annular configuration.

Figure 7:
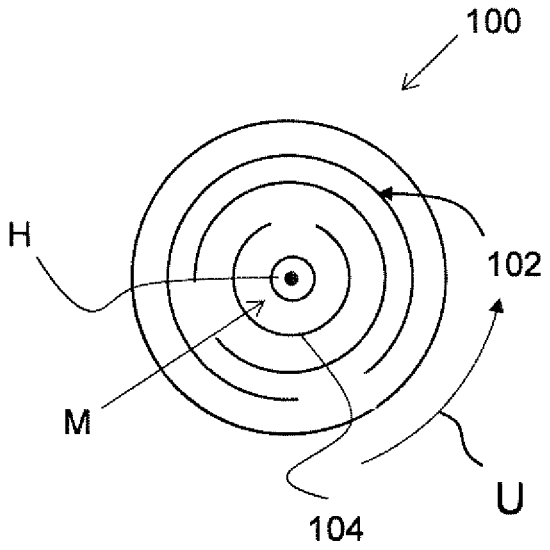
FIG. 7 shows a schematic view from above of a housing element with annular segment-shaped shoulders.
Figure 8:
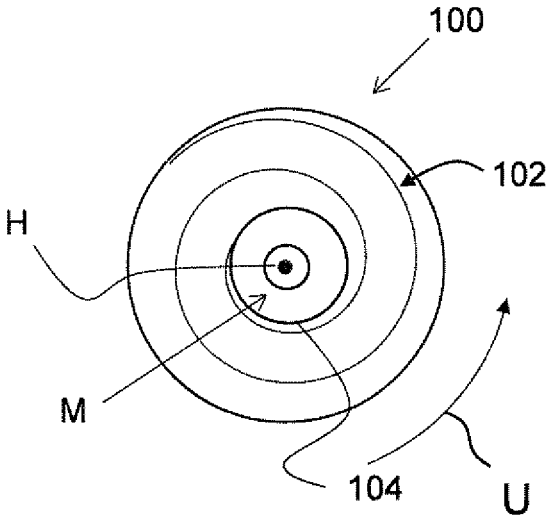
FIG. 8 shows a schematic view from above of a housing element with a spiral-shaped shoulder.

Alternatively to the annular configuration, the shoulders 102 may be configured to be annular segment-shaped according to FIG. 7, wherein the shoulders 102 run in the circumferential direction U around the central axis M and are arranged evenly spaced apart in the main flow direction H and the direction R2. A further possibility is to configure the shoulder 102 to be spiral-shaped, said shoulder being wound radially outwardly to the central axis M as shown in FIG. 8. In the case of a plurality of revolutions of the spirals, a plurality of shoulders, which in each case form an obstruction to a return flow, are also produced to a certain extent in section.

Figure 9:
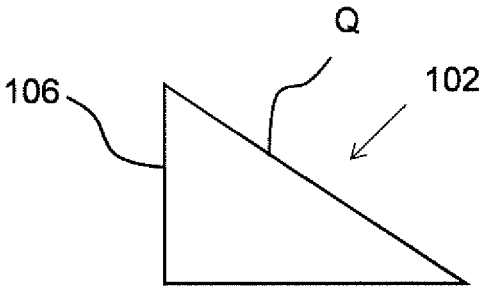
FIG. 9 shows a cross section of a shoulder.
Figure 10:
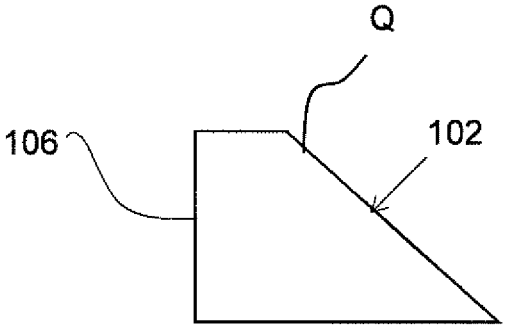
FIG. 10 shows a cross section of an alternative shoulder.

As shown in FIG. 9 a shoulder 102 has a wedge-shaped cross section Q. The shoulder 102 may also have a trapezoidal cross section Q according to FIG. 10. Further alternatives may have a round or oval cross section. Preferably, however, in the direction of the main flow direction H no cross-sectional tapering through the shoulders 102 is produced. In contrast, a stepwise cross-sectional tapering is produced in the direction counter to the main flow direction H.

Figure 11:
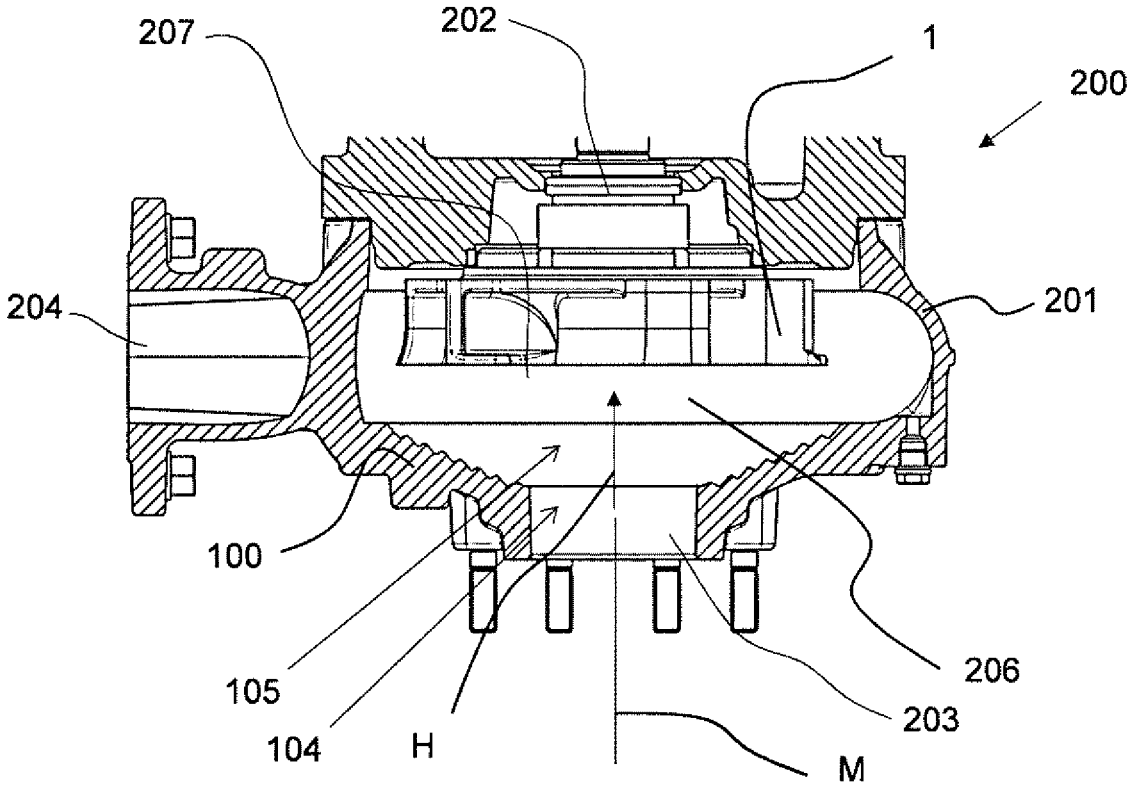
FIG. 11 shows a cross section through a pump.

A pump 200 according to the invention, which is configured as a vortex pump, has according to FIG. 11 a pump housing 201. A pump impeller 1 according to the invention is provided in the pump housing 201 as shown for example in FIGS. 1, 2, 3 and 4. The pump impeller 1 is rotatably mounted and is driven by a drive unit 202.

The fluid medium is able to be pumped through the pump housing 201 from a pump inlet 203 to a pump outlet 204. The pump inlet 203 and the pump outlet 204 are oriented at right-angles to one another. The pump outlet 204 leads radially from the pump impeller 1 out of an impeller chamber 206 in which the pump impeller 1 is located.

The pump housing 201 has a housing element 100 according to the invention. The housing element 100 forms a wall of the impeller chamber 206. The pump impeller 1 is arranged in the main flow direction H opposite the housing element 100, wherein the central axis M is parallel and coaxial to the rotational axis DA. The fluid inlet opening 104 of the housing element 100 is located in the region of the pump inlet 203. The flow channel 105 is arranged between the pump inlet 203 and the pump impeller 1. A free space 207 is formed in the flow channel 105 and between the pump inlet 203 and the pump impeller 1, no further flow guidance elements being provided therein. A vortex is formed in this space 207 since the fluid is excited into rotation by the pump impeller 1. An overpressure at the pump outlet 204 then leads to a return flow on the inner wall of the housing element 100. Here, the shoulders form obstructions to the flow for the return flow and conduct the return flow back into the main flow direction H.

Alternatively, the housing element 100 may be configured as a releasable top cover with a fastening flange and may be fastened by means of screws as a fastening device to the remaining pump housing 201.

A further alternative may consist in the housing element 100 being inserted as an insert into the interior of the pump housing 101. To this end, the pump housing 101 should form a seat for the housing element.

The invention is not limited to one of the above-described embodiments but may be modified in many different ways.

All of the features and advantages, including structural details, spatial arrangements and method steps, emerging from the claims, the description and the drawing may be essential to the invention both individually and in very different combinations.

| List of reference numerals | |
|---|---|
| 1 | Pump impeller |
| 11 | Impeller surface |
| 12 | Blade channel |
| 13 | Pumping channel |
| 14 | Impeller hub |
| 15 | Feather key groove |
| 16 | Gap |
| 17 | Blade wheel edge |
| 2 | Blade of first type |
| 21 | Base body |
| 22 | Blade edge |
| 23 | Blade suction surface |
| 24 | Blade pressure surface |
| 25 | Material thickness |
| 26 | Free end |
| 27 | Curvature |
| 3 | Blade of second type |
| 31 | Base body |

-continued

| List of reference numerals | |
|---|---|
| 32 | Blade cover |
| 34 | Blade pressure surface |
| 35 | Blade suction surface |
| 37 | Material thickness |
| 100 | Housing element |
| 101 | Surface structure |
| 102 | Shoulder, projecting portion, step |
| 103 | Housing inner wall |
| 104 | Fluid inlet opening |
| 105 | Flow channel |
| 106 | Inflow surface |
| 200 | Pump |
| 201 | Pump housing |
| 202 | Drive unit |
| 203 | Pump inlet |
| 204 | Pump outlet |
| 206 | Impeller chamber |
| 207 | Free space |
| b | Width of blade channel |
| l | Length of blade channel |
| DR | Rotational direction |
| DA | Rotational axis |
| H | Main flow direction |
| R | Direction radially to rotational axis |
| R2 | Radial direction |
| M | Central axis |
| Q | Cross-sectional profile |
| U | Circumferential direction |
| w1 | Angle |
| w2 | Angle |

The invention claimed is:

1. A housing element (100) for a pump (200) or of a pump (200), with a housing inner wall (103) which defines a flow channel (105) for a fluid medium extending along a central axis (M), wherein a cross section of the flow channel (105) is greater in a main flow direction (H), characterized in that the housing inner wall (103) has a surface structure (101) which is configured such that it counteracts a return flow counter to the main flow direction (H) along the housing inner wall (103) of the fluid medium, wherein the surface structure (101) of the housing inner wall (103) has a sloping surface portion, the sloping surface portion having at least three shoulders (102) formed thereon.

2. The housing element (100) according to claim 1, characterized in that each of the at least three shoulders (102) is configured in an annular or annular segment-shaped manner.

3. The housing element according to claim 1, characterized in that the each of the at least three shoulders (102) is configured to be spiral-shaped.

4. The housing element (100) according to claim 1, characterized in that the each of the at least three shoulders (102) is configured to be step-shaped, the surface structure (101) having an inflow surface (106) formed by each of the at least three shoulders, the inflow surface (106) protruding transversely into the return flow and counteracting the return flow.

5. The housing element (100) according to claim 1, characterized in that the housing element (100) is configured as a releasable top cover of a pump housing (201) and/or the housing element (100) forms an impeller chamber (206) of pump housing (201) and/or the housing element (100) is an insert element in the impeller chamber (206) of the pump housing (201).

6. A pump (200) with a pump housing (201) in which a pump impeller (1) is rotatably mounted, a fluid medium being able to be pumped from a pump inlet (203) of the pump housing (201) to a pump outlet (204) of the pump housing (201), wherein the pump housing (201) has a housing element (100) according to claim 1, the flow channel (105) thereof being arranged between the pump inlet (203) and the pump impeller (1).

7. The pump (200) according to claim 6, characterized in that the pump impeller (1) is arranged in the direction of the main flow direction (H) relative to the surface structure (101) of the housing element (100).

8. The housing element (100) according to claim 1, wherein each of the at least three shoulders (102) is wound radially outwardly starting from the central axis (M).

9. The housing element (100) according to claim 1, further comprising at least four shoulders.

10. The housing element (100) according to claim 1, wherein the at least three shoulders are evenly spaced apart along the sloping surface portion.

* * * * *